US005568874A

United States Patent [19]

Robinson

[11] Patent Number: 5,568,874

[45] Date of Patent: Oct. 29, 1996

[54] HANGING FILE FRAME

[76] Inventor: Calford E. Robinson, 100 Leander St., Bramalea Ontario, Canada, L6S 3N8

[21] Appl. No.: 378,711

[22] Filed: Jan. 26, 1995

[51] Int. Cl.[6] ..... A47F 5/00

[52] U.S. Cl. ..... 211/46

[58] Field of Search ..... 211/46, 189; 312/184

[56] References Cited

U.S. PATENT DOCUMENTS 5,111,941 5/1992 Hillestad ..... 211/46

*Primary Examiner*—Alvin C. Chin-Shue
*Assistant Examiner*—Sarah L. Purol

[57] ABSTRACT

A horizontal file rack is composed of two longitudinal horizontal members and two end members of the shape of a U. The end members each have two standards which define loops which allow slantwise insertion of a horizontal member but which make a fixed connection when a horizontal member and a standard are mutually perpendicular.

12 Claims, 2 Drawing Sheets

HANGING FILE FRAME

This invention relates to means providing a frame for hanging files. The inventive frame may be used to convert file drawers to receive hanging files or to stand alone on a desk top or other surface. The hanging file frame provides file drawers designed to rest on the bottom of a file drawer or on another surface to receive files with suspension rails on each side of the frame on which the hanging files may be suspended.

The invention is of the class of devices which provide vertical standards to stand on the bottom of the drawer near its four corners, which standards are connected by transverse members joining their lower ends to form an U-shape at the forward and rearward ends of the frame. The standards and transverse members support longitudinal rails adjacent the top of the frame, and on each side thereof; located to support vertical hanging files. Prior devices of the above type, known to applicant, have required nuts and bolts or extra fittings for assembly, and for this and other reasons are inconvenient to transport and to assemble and disassemble.

Applicant provides a frame which is very economical to manufacture and easy to transport in compact kit form and to assemble by mechanical interlock, without requiring extra bolts or connection members.

In U.S. Pat. No. 5,071,014 dated Dec. 10, 1991, issued and owned by the applicant herein, there is disclosed a frame for vertical hanging files which is constructed, and operated, in the manner described above. The frame described therein has been very successful and efficient. However, in the present economic times, there is a constant pressure to provide a lower priced product which has the same advantages.

Accordingly, this invention provides a frame for the purposes above described, differently constructed and connected from that described in my previous patent, and designed to meet the essential requirements for such frame, which providing a design which is convenient and which may be manufactured at lower cost than the frame of U.S. Pat. No. 5,071,014. The novel design broadly embraces a preferred design requiring only two pairs of respectively identical members, which requires only simple assembly techniques.

In accord with the invention there are provided a pair of longitudinal members shaped to define, in use, a section of predetermined height between upper and lower substantially parallel edges along extents terminating at each end of said standards. For use with the standards there are provided a pair of slightly resiliently bendable transverse members having the general shape of a U having two uprights and a cross-bar when viewed in the longitudinal direction. Means are provided at the upper end of each upright defining a downwardly open upper bight and an upwardly open lower bight. The mutually facing open bights define profiles of a passage for longitudinal movement of the longitudinal members. The profile viewed in the longitudinal direction (which is perpendicular to the rest attitude of the uprights) is just less than the height of the longitudinal member extent section but the profile in an insertion direction (which is at a small angle to the longitudinal direction) is high enough to receive the longitudinal member extents slidably. The member extent inserted in the insertion direction is rotated into the longitudinal direction, making a pressure fit with the longitudinal member. The upper and lower bights define the vertical angle measured in opposite senses at each end of the transverse member. This has the effect that each transverse member is the subject of opposing torques. This provides a firm connection between the uprights and the longitudinal members and contributes to the rigidity to the frame as a whole. There results a very small misalignment of the uprights from the vertical in the assembled frame and a slight twisting of the longitudinal members, but this is not enough to interfere with the efficacy of the product.

Preferably the bights and uprights are arranged so that the vertical angle is in the same sense, for the two uprights connected to the same longitudinal member. This allows both transverse members to be identical.

Preferably the bights are provided on the uprights by having each upwardly extending upright extend upwardly to terminate in a first hairpin turn connected to a first length extending downwardly therefrom, the first hairpin turn defining a downwardly open bight, the lower end of said first length connected to an upwardly extending second length by an upwardly open bight, where said bights provide said first and second concavities when viewed in the longitudinal direction, the upper and lower bounds of a first profile of a passage, the separation of said bounds in said profile being slightly less than said height. The bights, at a small vertical angle displaced from said longitudinal direction (about an axis perpendicular to the upright and the longitudinal members), define the upper and lower bounds of a second profile of said passage, which is dimensioned to slidably receive the end of a longitudinal member.

In drawings which illustrate a preferred embodiment of the invention:

Figure 1:
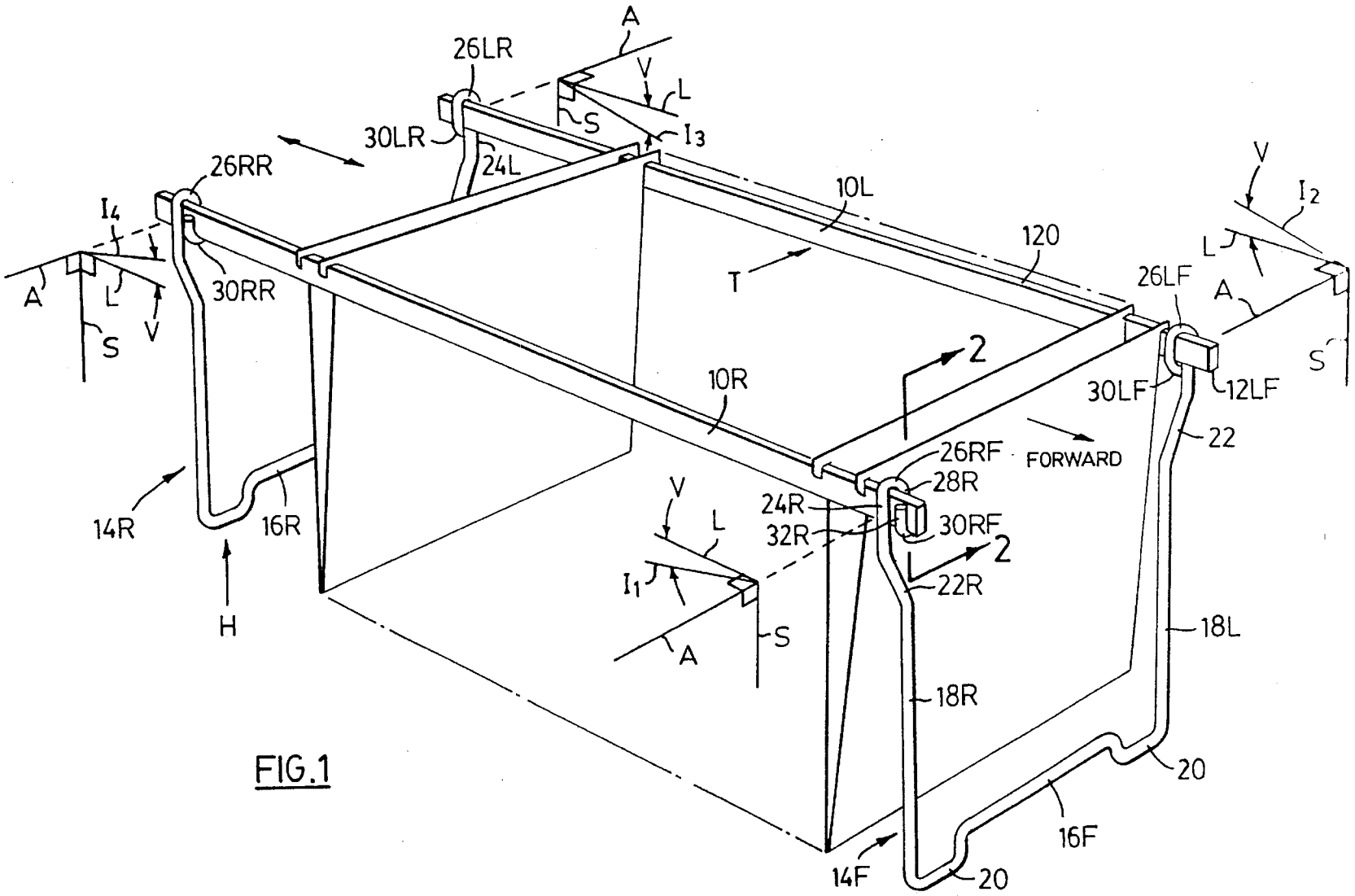
FIG. 1 is a perspective view of the assembled frame.

In the drawings, the forward and rearward directions are shown and a pair of longitudinal members 10 R and 10 L define in section parallel upper and lower edges 12U and 12L and a height Large relative to the thickness. The members 10R and 10L are substantially rigid to bending about axes in the thickness direction T, but allow bending about axes parallel to the height direction H and torsion about the longitudinal axis.

A pair of identical transverse members 14F and 14R are provided. Such transverse members are each preferably formed from a single integral resiliently bendable steel rod. Thus only one will be described member 14F 14R is generally shaped as a U with a cross-bar 16 and right and left uprights 18R and 18L.

Each cross-bar 16 is preferably provided with stepped down extents 20 at each end, to slightly raise the centre of the cross-bar above a file drawer floor to clear any raised portions in the centre of such floor.

Towards its upper end, each upright slopes outwardly at extent 22 away and the opposite upright from the upper end of extent 22 extends vertically along extent 24.

The upper end of extent 24R is bent inwardly and forwardly to form a concave downward bight 26R. The bight 26R extends into downward length 28R, at its lower end is bent outwardly and forwardly in a hairpin turn to form a concave upward bight 30R extending into the upward short length 32R.

Figure 2:
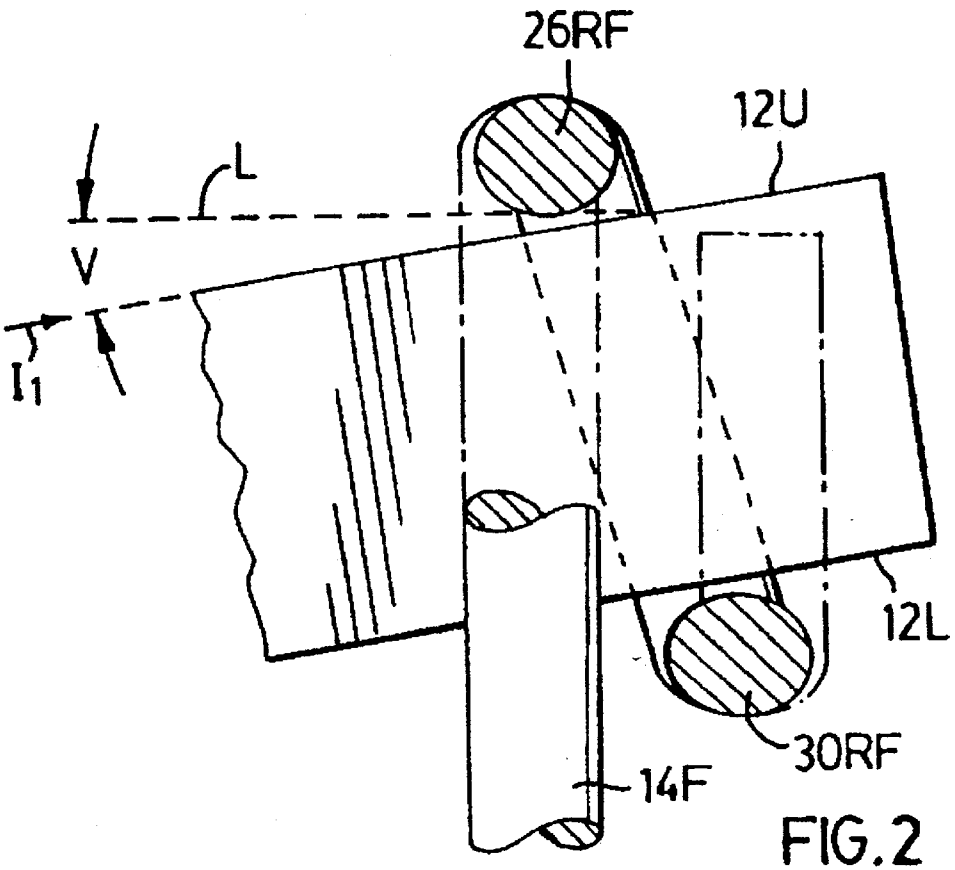
FIG. 2 is a detailed view of a standard being inserted in the insertion direction between upper and lower bights.
Figure 3:
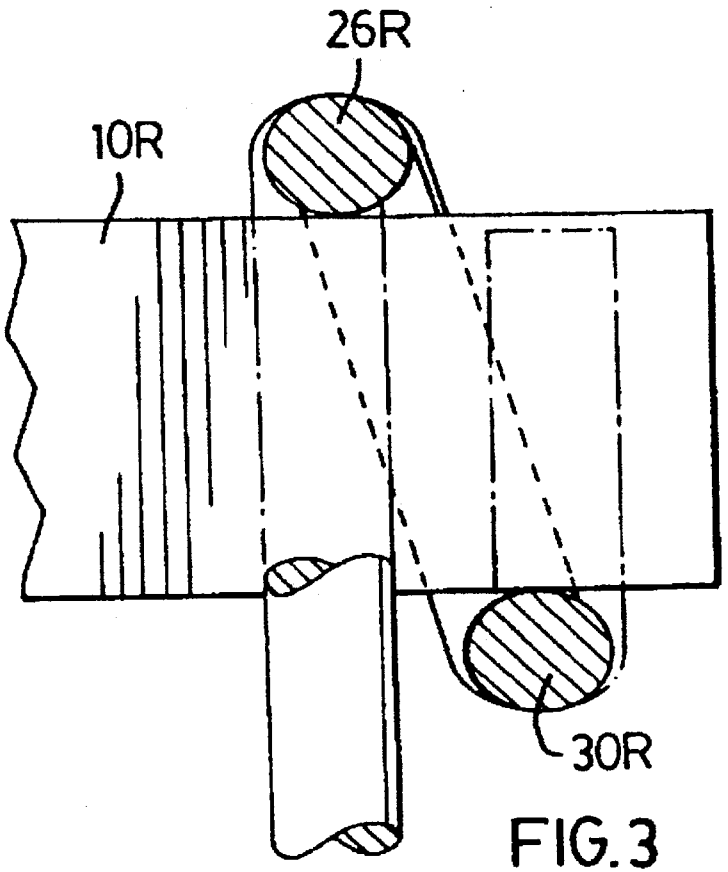
FIG. 3 is a view of the standard, which was inserted in FIG. 2, oriented to be perpendicular to the upright.

The bight 30R is displaced forwardly from bight 26R as best shown in FIGS. 2 and 3. The lateral spacing between lengths 24R and 32R on the one hand and 28R on the other is sufficient to slidably receive the thickness of longitudinal member 10R. The vertical spacing between the lower side of bight 26R and the upper side of bight 30R is slightly less than the height of longitudinal member 10R so that the perpendicular attitude shown in FIG. 2 represents the pressure of a slight negative tolerance.

On the other hand the spacing between bights 26R and 30R when looking along the insertion direction I is greater than the height of the longitudinal member 10R so that the longitudinal member may easily be inserted between the bights when slid in the insertion direction. Once located between the bight the longitudinal member may be rotated through the angle V to the longitudinal direction L where bights 26R and 30R make a pressure contact with the member 10R edges.

The arrow I indicates relative translation of the longitudinal member relative to the bights and has the same direction whether the member 10R is actually moved forwardly to stationary bights or the bights are actually moved rearwardly toward a stationary member 10R.

The arrow for angle V indicates relative rotation about axes A of the longitudinal member relative to the bights 26R and 30R and has the same direction whether the member 10R is actually rotated clockwise looking to the right in FIG. 1 with the bights stationary or whether the bights are actually rotated counterclockwise about axis A relative to a stationary longitudinal member.

The left-hand standard 18L is provided with a similar construction and curved to define bights 26L and 30L, are inboard of the standard 18L but the bights are angled so that bight 30L is displaced in the rearward longitudinal direction from bight 26L.

It will be noted that the angle V is measured about an axis A perpendicular to the longitudinal members and the main upright direction is the assembled frame. V is the angle of rotation from the insertion direction to the longitudinal direction of the longitudinal member to the upright V is in the opposite sense at opposite ends of a transverse member. For description later the four insertion directions I at the four corners are numbered I1, I2, I3, I4 as shown.

For the purposes of description later the pairs of bights 26R and 30R on the right side of the frame are designated 26RF and 30 RF (front) and 26 RR and 30 RR (rear). Similarly the pairs of left hand bights 26L and 30L are designated 26 LF and 30 LF (front) and 26 LR and 30 LR (rear).

It should be noted that when a longitudinal member is inserted in one of the bight defined passages, it tends to assume an angle of, preferably, about 12° to the standard but may be bent perpendicular thereto because of the resilient dependability of the standards.

To use the device, the longitudinal members are first measured against the length of the drawer and, if too long, are cut down tp a length to be received within the drawer by sawing, cutting or the like. Transverse members 14F and 14R are typically provided in a width which is letter or legal size, and must of course be compatible with the drawer width if inserted therein.

The longitudinal members may be inserted between bight pairs in any order so that the choice will be the personal preference. However, I believe it is preferable to commence by first inserting both longitudinal members in one transverse member.

Accordingly, if longitudinal member 10R is first inserted between bights 26 RF and 30 RF then this is done along the direction I1 as indicated in FIG. 3. Next the longitudinal member 10L is inserted between bights 26 LF and 30 LF along direction I2.

At this instant the member 10L will make an obtuse angle with standard 18L and member 10R will make an acute angle with standard 18R.

Bights 26 LR and 30 LR of the rearward member 14R are then threaded onto the rearward end of member 10L so that the member 10L moves in the relative insertion direction 13.

Lastly member 10R is to be inserted between bights 26RR until the relative insertion angle 14 may be achieved. (It being noted that I3 is parallel to I2 and I4 is parallel to I1). This involves the application of torsional stress to the right hand rear upright 14R to achieve the insertion angle 14 which applies torsional and bending stresses on transverse member 14R and stresses on the members 10R and 10L, which result in torsional and bending stresses on transverse member 14F.

As a result of the torsional and bending stresses on the two transverse members 14R and 14F these assume positions where upright 18R and 18L of the forward transverse member and uprights 18R and 18L of the rearward member are nearly co-parallel. Each upright 18R is slightly misaligned from its counterpart 18L because of the opposed stresses by the longitudinal members thereon. There is a slight twist about a longitudinal axis on each longitudinal member 10R because of the stresses exerted by the bight pairs. However, neither of these stresses induced deviations from rectilinearity to sufficiently distort the frame to destroy its stability or its ability to fit in a file drawer.

It will be noted that, due to the fact that the torques exerted by the two uprights on a transverse member are opposite, the transverse member approximately assumes an orientation where its standards are approximately parallel and perpendicular to the longitudinal direction. Due to the profile of the longitudinal member in the longitudinal direction and to the torsional and bendable resiliency of the transverse member, the two uprights of a transverse member slope slightly forwardly and rearwardly of the perpendicular direction. However, this produces a clamping action between the members at each bight profile and the longitudinal members creating the necessary rigidity for the rod to stand on at each end. The bights have on each side curved surfaces which exert a camming action tending to twist the longitudinal member (the direction does not matter) and this adds to the rigidity of the structure.

The upper end of each upright is preferably stepped outwardly, as shown, just below the bight forming ends to provide spacing for the lower extents of the standard from the drawer wall sides to clear any abutments or fillet or the lower end of the drawer sides.

It is understood that the upper and lower bights must be stepped in opposite directions at each end of a transverse member. With this understood some variations in the design shown are available. In the embodiment shown the right hand rear and front upright have the bights stepped forwardly in the same direction. This allows the front and rear transverse members to be identical. However, the front and rear transverse members may be made so that on each side one has the bights stepped forwardly and the other the bights stepped rearwardly. This will provide a rigid rack but two different transverse members must now be produced.

A further variant may be provided by forming the bights at each end of the transverse member on the outside of the upright with one side having the bights stepped forwardly and the other side having the bights stepped rearwardly. In such case the outward step of the upright to space its lower extent from the side wall is not required since such outward step is provided by the bight formation.

I claim:

1. Horizontal file rack comprising:

a pair of longitudinal members shaped to define, in use, a section of predetermined larger height and smaller thickness along longitudinal extents at each end, said height being defined between upper and lower edges, a pair of slightly resiliently deformable transverse members having the general shape of a U when viewed in the longitudinal direction, whereby each transverse member terminates in a pair of spaced uprights, each upright terminating in a first hairpin turn connected, at its upper end, to a first, downwardly extending length connected at its lower end by a second hairpin turn to a second, upwardly extending length, the connection between said upright and said first length defining a downwardly open bight and the connection between said first length and said second length defining a upwardly open bight, said bights defining, when viewed in the longitudinal direction, the upper and lower bounds of a first profile of a passage, the separation of said bounds being slightly less than said height, said bights defining an insertion direction, at a small vertical angle about an axis perpendicular to the upright and the longitudinal members, rotationally displaced in a predetermined sense from said longitudinal direction, the upper and lower bounds of a second profile of said passage dimensioned to slidably receive the end of a longitudinal member, said bights being arranged to define said passage so that the insertion direction is displaced through an opposite sense from the longitudinal direction at opposite uprights of the same transverse member.

2. Horizontal file rack comprising:

a pair of longitudinal members shaped to define, in use, a section of predetermined height between upper and lower, substantially parallel edges, over extents at each end of said standards, a pair of slightly resiliently bendably deformable transverse members having the general shape of a U having two uprights and a connecting cross-bar when viewed in the longitudinal direction, means at the upper end of each upright defining a passage for one of said longitudinal members, said defining means being arranged so that said passage in a first profile viewed in said longitudinal direction, is of slightly less height than said longitudinal member, but so that said passage in profile viewed in an insertion direction at a small vertical angle about an axis perpendicular to said upright and said longitudinal member in a predetermined sense to said longitudinal direction, has a height to slidably receive said standard, but wherein the vertical angle between said insertion direction and the longitudinal direction is in an opposite sense on uprights at opposed ends of a transverse member.

3. Horizontal file rack comprising:

a pair of longitudinal members shaped to define, in use, a section of predetermined height between upper and lower, substantially parallel edges, along extents at each ends of said members, a pair of slightly resiliently bendable deformable transverse members having the general shape of a U having two uprights and a cross-bar when viewed in the longitudinal direction, means at the upper end of each upright defining upper downwardly open and lower upwardly open bights adapted to receive, respectively, said upper and lower edges and to restrain thereby, said longitudinal member against relative transverse movement, said bights being adapted to slid ably receive one of said longitudinal member extents on longitudinal sliding in an insertion direction at a small vertical angle about an axis perpendicular to said upright and said longitudinal members measured in one sense from said longitudinal direction, said upper and lower bights being arranged so that the vertical angle is in the opposite sense at uprights at opposite ends of each said transverse member.

4. A horizontal file rack as claimed in claim 1 wherein the pair of uprights on one side, and the prior on the other, have, respectively, the same sense of vertical angle displacement of said insertion from said longitudinal direction.

5. A horizontal file rack as claimed in claim 2, wherein the pair of uprights on one side, and the pair on the other, have, respectively, the same sense of vertical angle displacement of said insertion from said longitudinal direction.

6. A horizontal file rack as claimed in claim 3, wherein the pair of uprights on one side, and the pair on the other, have, respectively, the same sense of vertical angle displacement of said insertion from said longitudinal direction.

7. Horizontal file as claimed in claim 1, wherein said first lengths are located inward of said uprights.

8. Horizontal file as claimed in claim 2, wherein said passages are located inward of said uprights.

9. Horizontal file as claimed in claim 3, wherein said bights are located inward of said uprights.

10. Horizontal file as claimed in claim 4, wherein said first lengths are located inward of said uprights.

11. Horizontal file as claimed in claim 5, wherein said passages are located inward of said uprights.

12. Horizontal file as claimed in claim 6, wherein said bights are located inward of said uprights.

* * * * *